United States Patent [19]

Penttinen

[11] Patent Number: 4,619,854

[45] Date of Patent: Oct. 28, 1986

[54] WATERPROOF, WEATHER-RESISTANT AND SUBSTANTIALLY NON-STRETCHING TEXTILE A METHOD FOR PRODUCING IT, AND A COMPONENT MADE FROM IT

[75] Inventor: Kyösti Penttinen, Helsinki, Finland

[73] Assignee: Tikkurilan Varitehtaat Oy, Finland

[21] Appl. No.: 738,052

[22] Filed: May 24, 1985

[30] Foreign Application Priority Data

Jun. 12, 1984 [FI] Finland ..... 842378

[51] Int. Cl.[4] ..... B32B 7/00

[52] U.S. Cl. ..... 428/99; 427/407.3; 427/412; 428/58; 428/251; 428/268; 428/273; 428/421; 428/422; 428/423.3; 428/424.6; 428/425.6; 428/473.5

[58] Field of Search ..... 428/251, 268, 273, 423.3, 428/424.6, 425.6, 473.5, 421, 422, 58, 99; 427/407.3, 412

[56] References Cited

U.S. PATENT DOCUMENTS 4,454,191 6/1964 Von Blücher ..... 428/251

*Primary Examiner*—Marion C. McCamish

*Attorney, Agent, or Firm*—McCormick, Paulding & Huber

[57] ABSTRACT

The invention relates to a waterproof, weather-resistant and substantially non-stretching textile, which is a substantially non-stretching, tension-resistant cloth coated with a weather-resistant synthetic substance. According to the invention, a glass-fiber cloth is first impregnated with polyurethane or polyacrylate in order to form a continuous coating-base for a weather-resistant synthetic substance, which is polyimide or fluorinated or chlorinated polyurethane, polyacrylate or polyethylene such as PVC.

16 Claims, No Drawings

WATERPROOF, WEATHER-RESISTANT AND SUBSTANTIALLY NON-STRETCHING TEXTILE A METHOD FOR PRODUCING IT, AND A COMPONENT MADE FROM IT

BACKGROUND OF THE INVENTION

The present invention relates to a waterproof, weather-resistant and substantially non-stretching textile, and in particular to a substantially non-stretching, tension-resistant cloth coated with a weather-resistant synthetic substance.

It is previously known to coat textiles with some synthetic substance suitable for this purpose. The following polymers, among others, have been used as coating substances for textiles: polyurethane, polyvinyl chloride and its copolymers, polyethylene, copolymer of ethylene and vinyl acetate, esters and copolymers of polyacrylic acid, polyamides, synthetic rubber and its copolymers, and silicon rubber. A continuous polymer film can be formed from a polymer dissovled or dispersed in a organic solvent, when the solvent is evaporated from the system, or, alternatively, the polymer can be applied to the textile in the form of an aqueous dispersion, whereby a continuous polymer film is formed on the textile when the water is evaporated from the dispersion. Thermoplastic polymers can also be added in the molten state.

A textile can be made waterproof by forming a continuous polymer film on the textile. The strength properties of a coated textile depend primarily on the material selected for the base cloth, the thickness of its yarn, the yarn density in the warp and in the weft, and the weave. By a suitable selection of these, a textile is obtained which has the desired strength values and which does not in use substantially stretch under loading. However, a cloth of this type is not as such waterproof and weather-resistant. Waterproofness is obtained by coating the textile with some suitable synthetic substance and, if elasticity is required in the product, for example, an ability to be rolled, the polymer used for the coating must be flexible, i.e. stretching. This property can be achieved by means of a polymer formed even from one monomer type, but usually the desired properties are achieved by using copolymers formed from different monomers. The polymer can be given additional softness and flexibility by using so-called external softeners.

From the publication Textilveredlung, VEB Fachbuchverlag, Leipzig, 1981, 1. Auflage, it is known to form numerous coatings for textiles, and it is stated that coatings prepared from aqueous dispersions of polyurethane do not have properties as good as have the solvent-based coatings, but their importance is increased by the elimination of the disadvantages caused by solvents. In addition it is stated in the publication that only a few polyacrylates have importance as textile coating substances.

It is also previously known to coat a glass-fiber fabric with an aqueous dispersion of polyurethane, whereby a very strong and waterproof textile is obtained. The greater the demands set on the weather-resistance of such a product, the more expensive is the polyurethane dispersion to be used. The total price of the product then tends to rise very high, since polyurethane dispersion is required in a relatively large quantity to fill the pores in the textile to the effect that a completely waterproof product is obtained.

There are also known other synthetic substances by means of which especially good weather-resistance is produced. Other such substances are aromatic polyimides, the manufacture, properties and uses of which are described in, for example the publication Kemian teollisuus (Chemical Industry) 28 (1971) 2/97–101.

Modern applications of polymeric materials often require resistance to heat and thermal stability, both over a very wide range, and in particular long-term weather-resistance also in difficult and extreme conditions and in rapidly changing extreme conditions. This is especially true regarding technical textiles and products made from them, for example buildings and structures, and in particular when they are used under arctic or tropical conditions.

It is known that the mechanical properties of polyimides usually remain unchanged when the external temperature varies even by 600°–700° C. For example, at a temperature of 500° C. a polyimide film is twice as strong as a polyethylene film is at room temperature. Its strength at room temperature is approximately the same as that of polyethylene terephthalate film, but considerably greater below 0° C. A polyimide film does not soften or melt, and its elasticity remains, between the temperatures −200° C. and +400° C.

On the basis of the above it is evident that aromatic polyimides are especially well suited for the coating of textiles which must be weather-resistant under very difficult and extreme conditions. Aromatic polyimides are, however, very expensive, and if they are used for coating textiles which are also required to be waterproof, they must be used in very large quantities, whereby the price of the product rises immoderately high.

The object of the present invention is thus to provide a waterproof and at the same time weather-resistant and substantially non-stretching textile with a more economical price, the textile being a substantially non-stretching, tension-resistant cloth coated with a smaller amount of weather-resistant synthetic substance than previously, as well as a method for producing such a textile.

The object of the present invention is, furthermore, to provide a waterproof and at the same time weather-resistant and substantially non-stretching, rollable textile component, intended for use for parts of a building or a structure which are subject to loads, the component being a substantially non-stretching, tension-resistant cloth coated with a smaller amount of weather-resistant synthetic substance than previously.

SUMMARY OF THE INVENTION

A waterproof, weather-resistant and substantially non-stretching textile according to the present invention thus consists of a glass-fiber cloth which has been impregnated with economically priced polyurethane or polyacrylate, which forms a continuous coating-base for the actual weather-resistant synthetic substance which withstands extreme conditions, this synthetic substance being a polyimide or a halogenated polyurethane, polyacrylate or polyethylene, preferably a halogenated surface layer of the impregnation agent.

The substantially non-stretching, tension-resistant cloth used is thus glass-fiber cloth having a tensile strength in the order of 300 kP/5 cm and a very low elongation, less than 5%. In spite of its high strength, such a glass-fiber cloth is very light, its weight being in the order of 400 g/m$^2$. Some adhesion-improving agent such as an organic silane, preferably glycidoxyproplytrimethoxy silane, can be added to the polymer mixture in order for the polymer to adhere well to the glass-fiber cloth.

DESCRIPTION OF THE PREFERRED EMBODIMENTS

In a preferred embodiment of the invention, a glass-fiber cloth impregnated with an aqueous dispersion of polyurethane or polyacrylate is contacted with fluorine gas while the surface of the cloth is still moist, whereupon the surface layer of the polyurethane or polyacrylate halogenates and thereby forms a very thin weather-resistant and chemical-resistant surface layer in the size range of a fluorinated polyurethane molecule, the layer being additionally an effective barrier to solvents and gases.

In addition, a textile which can be rolled is obtained, since the polymers used for the impregnation and coating of the cloth form stretching films, their stretching property being in the order of 100–300%, for example 200%.

The cloth is preferably impregnated with a mixture in which the basic polymer is an aliphatic polyurethane dispersion which has been modified with an anionic aliphatic polyurethane emulsion which softens the basic polymer, thereby at the same time enabling the elasticity of the product to be regulated, and this polymer has been further modified by cross-linking it with an aliphatic polyurethane emulsion in order to regulate the strength and toughness properties. The combined amount of the anionic aliphatic polyurethane emulsion and the aliphatic polyurethane emulsion in this mixture may be up to 50% by weight, in which case the amount of the latter constituent is, however, at maximum about 20% by weight.

According to the present invention, a substantially non-stretching, tension-resistant glass-fiber cloth which has been impregnated with an economically priced polymer is coated with either a halogenated polyacrylate, polyethylene or polyurethane or an aromatic polyimide, which withstand very severe conditions. The aromatic polyimide used for the coating of the textile according to the present invention can be prepared by, for example, allowing an aromatic diamine to react with an aromatic polyacid, its acyl halide or acid anhydride. For example 4,3′-diaminophenyl benzoate and pyromellite acid anhydride are advantageously used as the starting substances of such a polyimide, whereby an aromatic polyimide is obtained the thermal decomposition of which does not begin until at about 450° C.

Such a polyimide material can be spread onto the surface of a textile according to the present invention as a very thin film the thickness of which is preferably about 2–180 μm, for example 2–10 μm. Although the weather-resistant coating is relatively expensive, the total price of the product will not in this case rise to an immoderately high level.

The halogenated polyurethane or polyacrylate which is used as the weather-resistant coating of a textile according to the invention is preferably formed by subjecting the polyacrylate- or polyurethane-impregnated glass-fiber cloth to a fluorine atmosphere before the surface layer of the cloth has dried, in order to halogenate the surface layer.

Illustrative examples of halogenated polyethylenes are polyvinylchloride and polyvinylfluoride, especially tetrafluorethylene and $PVF_2$.

A weather-resistance of equal quality can also be obtained by a separate halogenated hydrocarbon polymerate e.g. by polyvinylidene fluoride, for example Kynar 500 (Pennwalt Corporation). An advantageous base is hereby a back cloth textile web prepared from a combination of a 100-percent acrylic emulsion, for example Primol AC-388, and glass fiber cloth. The polyvinylidene dipersion is applicated by paint technical means, the hardening takes place at about 240° C. in one minute.

The glass-fiber cloth used as the substantially non-stretching, tension-resistant cloth of the textile according to the invention can, as any coating base, be coated by using a roller. On an industrial scale the coating is carried out on industrial coating production lines commonly used in the paint industry, for example, by using the calander technique, the dipping-vat technique, or the curtain-machine technique. It is also possible to use the paper coating technique known from the plastics industry, or the Hotmelt technique. Alternatively, it is possible to use direct or indirect coating methods known from textile coating technology, etc. Textile components of suitable size, preferably having a length of about 25 m and a width of about 1.2 m can be made from the waterproof weather-resistant and substantially non-stretching textile according to the invention. Such components can be joined together to form larger entities, for example by sewing, by glueing, or by means of a zipper connection in which, for example, zippers having polyacetate teeth are fastened to the cloth by their tape by means of a 2-needle machine; the tape can be of polyester. The zipper connection can, furthermore, advantageously be covered with a tape or a self-adhesive ribbon, whereupon the zipper connection remains under the edge of the textile component. The connecting can in this case be carried out on site to form the entity required by the use, and when the need for it changes or ceases the textile building can be dismantled into its components.

The textile components according to the present invention can be used for making textile buildings or structures, in which larger proportion of the load on the frame than previously can be transferred to the textile components, and thus the frame structure can be made lighter, and at the same time less expensive.

The uses include technical textiles, for example hydraulic and soil structures, shelters, sheds, storages and awnings, as well as various pioneering equipment such as bridges, runner-less sleds, boats, tents, camouflage, obstacles and enclosures. The textiles according to the invention can also be used in agriculture for the construction of animal shelters, cowsheds, production premises, storages and silos. The textiles according to the invention are expecially usable in arctic and tropical construction, and they can be used even in conditions as severe as outer space.

The invention is described below in greater detail with the aid of examples.

EXAMPLE 1

A glass-fiber cloth having a tensile strength of 300 kP/5 cm, an elongation less than 5%, and a weight of 400 g/m$^2$ was impregnated with a water-thinned aliphatic-anionic emulsion-dispersion mixture, the composition of which was varied as shown in Table 1 below.

TABLE 1

| Mixture | | | Properties of free film | |
|---|---|---|---|---|
| 1 | 2 | 3 | Tensile strength N/mm$^2$ | Elongation % |
| 100% | — | — | | 20 |
| 80% | 15% | 5% | | 227 |
| 60% | 20% | 20% | 16.5 | 197 |
| 50% | 25% | 25% | 16 | 150 |
| 50% | 10% | 40% | 24 | 35 |
| 50% | 40% | 10% | 16 | 295 |

The composition of mixtures 1, 2 and 3 was as follows:

| | | Content % | |
|---|---|---|---|
| | | paint | varnish |
| Auxiliary solvent | Propylene glycol | 20 | — |
| | Water | 100 | — |
| Defoamer | Defoamer 388 K | 2 | — |
| Dispersing agent | Dispex GA | 10 | — |
| "Poison in cans" | Proxel GLX | 0.8 | — |
| Pigment | Finntitan RR | 230 | — |
| Bonding agent 1 | Witcobond W 234[a] | 485 | 770 |
| Bonding agent 2 | Witcobond W 290 H[b] | 61 | 100 |
| Bonding agent 3 | Witcobond W 240[c] | 60 | 100 |
| Thickener | Borchigel L 75 | 10 | 10 |
| Surfactant | Surfynol 104 E | 10 | 10 |
| Defoamer | Defoamer 388 K | 5 | 5 |
| " | " | 5 | 5 |

[a]a colloidal dispersion of aliphatic urethane, solids content 30%.
[b]an anionic, low-viscosity urethane latex, solids content 60%.
[c]self cross-linking, water-containing polyurethane dispersion, solids content 30%.

A glass-fiber cloth impregnated with these mixtures was finally coated with an organic polyimide which had been prepared by reacting 4,3'-diaminophenyl benzoate with pyromellite acid anhydride. The textile obtained as a result was very strong, waterproof, and weather-resistant under severe and rapidly changing extreme conditions.

EXAMPLE 2

The glass-fiber cloth used in Example 1 was impregnated with an acrylate varnish having the following composition:

| | Amount, % | |
|---|---|---|
| Primal AC-388 | 68 | |
| Water | 10 | |
| Propylene glycol | 5 | auxiliary solvent |
| Texanol | 1 | auxiliary solvent |
| Nopco NXZ | 0.2 | defoamer |
| Primal ASE 60 (50%) | 10 | thickener |
| Ammonia (25%) | 0.2 | |
| Water | 4.1 | |
| Nopcoside N54D | 1.5 | poison |
| | 100 | |

Primal AC-388 is a 100-percent acrylic emulsion marketed by Rohm & Haas, having a solids content of 49.5–50.5%. The elongation of a film prepared from this acrylate mixture was measured as being 300%, and its tensile strength as being 5N/mm$^2$. When a glass-fiber cloth impregnated with this mixture was finally coated with the organic polyimide according to Example 1, a waterproof and substantially non-stretching textile was obtained which had thermal resistance and thermal stability over a very wide range.

What is claimed is:

1. A waterproof, weather-resistant and substantially non-stretching textile, comprising a glass-fiber cloth impregnated with at least one compound selected from polyacrylate and polyurethane, which forms a continuous coating-base for a weather-resistant synthetic coating selected from the class of compounds comprising aromatic polyimides and halogenated polyurethanes, polyacrylates and polyethylenes.

2. A textile according to claim 1, in which the thickness of the halogenated layer of the polyurethane, polyacrylate or polyethylene is in the order magnitude of a halogenated polymer molecule.

3. A textile according to claim 1, in which the thickness of the polyimide layer is 2–180 μm.

4. A waterproof, weather-resistant and substantially non-stretching textile, comprising a glass-fiber cloth impregnated with at least one compound selected from polyacrylate and polyurethane, which forms a continuous coating-base for a weather-resistant synthetic coating of polyvinylchloride.

5. A waterproof, weather-resistant and substantially non-stretching textile, comprising a glass-fiber cloth impregnated with at least one compound selected from polyacrylate and polyurethane, which forms a continuous coating-base for a weather-resistant synthetic coating of polyvinylfluoride.

6. A waterproof, weather-resistant and substatially non-stretching textile component, intended for use for a part which is subject to loads in a building or a structure, and comprising a substantially non-stretching, tension-resistant cloth of glass-fiber impregnated with at least one compound selected from polyurethane and polyacrylate, substantially more stretching then the glass-fiber cloth, said compound forming a continuous coating-base for a weather-resistant synthetic coating selected from at least one compound, comprising polyimides and halogenated polyurethanes, polyacrylates and polyethylenes.

7. A textile component according to claim 6, wherein at least one of its sides is coated with fluorinated polyurethane, polyacrylate or polyethylene.

8. A textile component according to claim 7 and adapted to be connected to adjacent textile components, comprising a zipper attached to its edges or near its edges.

9. A textile component according to claim 6, and adapted to be connected to adjacent textile components, comprising a zipper attached to its edges or near its edges.

10. A waterproof, weather-resistant and substantially non-stretching textile components, intended for use for a part which is subject to loads in a building or a structure, and comprising a substantially non-stretching, tension-resistant cloth of glass-fiber impregnated with at least one compound selected from polyurethane and polyacrylate, substantially more stretching than the glass-fiber cloth, said compound forming a continuous coating-base for a weather-resistant synthetic coating of polyvinylchloride.

11. A waterproof, weather-resistant and substantially non-stretching textile component, intended for use for a part which is subject to loads in a building or a structure, and comprising a substantially non-stretching, tension-resistant cloth of glass-fiber impregnated with at least one compound selected from polyurethane and polyacrylate, substantially more stretching than the glass-fiber cloth, said compound forming a continuous coating-base for a weather-resistant synthetic coating of polyvinylfluoride.

12. A waterproof, weather-resistant and substantially non-stretching textile component, intended for use for a part which is subject to loads in a building or a structure, and comprising a substantially non-stretching, tension-resistant cloth of glass-fiber impregnated with at least one compound selected from polyurethane and polyacrylate, substantially more stretching than the glass-fiber cloth, said compound forming a continuous coating-base for a weather-resistant synthetic coating of polyvinylchloride at least one side of said component also coated with fluorinated polyurethane, polyacrylate or polyethylene.

13. A waterproof, weather-resistant and substantially non-stretching textile component, intended for use for a part which is subject to loads in a building or a structure, and comprising a substantially non-stretching, tension-resistant cloth of glass-fiber impregnated with at least one compound selected from polyurethane and polyacrylate, substantially more stretching than the glass-fiber cloth, said compound forming a continuous coating-base for a weather-resistant synthetic coating of polyvinylfluoride at least one side of said component being coated with fluorinated polyurethane, polyacrylate or polyethylene.

14. A method for the production of a waterproof, weather-resistant and substantially non-stretching textile comprising first impregnating a glass-fiber cloth with at least one compound selected from polyurethane and polyacrylate in order to form on the cloth a continuous coating-base and then coating it with a weather-resistant coating selected from at least one compound comprising aromatic polyimides and halogenated polyurethanes, polyacrylates and polyethlenes as a thin layer.

15. A method according to claim 14, in which the glass-fiber cloth is impregnated with an aqueous dispersion of polyurethane or polyacrylate, which after drying is coated with the synthetic coating.

16. A method according to claim 14, in which the glass-fiber cloth is impregnated with an aqueous dispersion of polyurethane or polyacrylate and, before the drying of the surface of the polyurethane or polyacrylate dispersion, it is exposed to a fluorine atmosphere in order to halogenate the surface layer.

* * * * *